US006892873B2

(12) United States Patent
Chien et al.

(10) Patent No.: US 6,892,873 B2
(45) Date of Patent: May 17, 2005

(54) COIN DETECTOR FOR USE IN A COIN ACCEPTOR

(75) Inventors: Tien-Yuan Chien, Taipei (TW); Chun-Yi Lu, Taipei Hsien (TW); Cheng-Yi Lin, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 10/350,057

(22) Filed: Jan. 24, 2003

(65) Prior Publication Data

US 2004/0144617 A1 Jul. 29, 2004

(51) Int. Cl.[7] ..... G07D 5/08
(52) U.S. Cl. ..... 194/318
(58) Field of Search ..... 194/318, 302, 194/317, 328, 320; 73/163

(56) References Cited

U.S. PATENT DOCUMENTS 3,901,368 A * 8/1975 Klinger ..... 194/317
4,441,602 A * 4/1984 Ostroski et al. ..... 194/318
4,574,936 A * 3/1986 Klinger ..... 194/318
4,678,994 A * 7/1987 Davies ..... 324/236
5,411,126 A * 5/1995 Seitz ..... 194/317
6,305,523 B1 * 10/2001 House et al. ..... 194/317

FOREIGN PATENT DOCUMENTS

EP 0.500.367 A2 * 8/1992 ..... G07D/5/08

* cited by examiner

*Primary Examiner*—Donald P. Walsh
*Assistant Examiner*—Mark J. Beauchaine

(57) ABSTRACT

A coin detector installed in the track of a coin acceptor at a back side of a face panel is constructed to include a frequency oscillation circuit, the oscillation circuit assembly being formed of two printed circuit boards symmetrically disposed at two sides of the track of the coin acceptor each printed circuit board having a spiral coil and adapted to measure the inductance value of the coin passing through, a frequency switching circuit for setting reference values, and a CPU adapted to compare the inductance value of the coin detected by the oscillation circuit assembly to reference values obtained from the frequency switching circuit so as to determine the authenticity and value of the coin detected.

18 Claims, 6 Drawing Sheets

COIN DETECTOR FOR USE IN A COIN ACCEPTOR

BACKGROUND OF THE INVENTION

1. Field of the Invention

The present invention relates to coin acceptors and, more specifically, to a coin detector for use in a coin acceptor, which uses spiral coils to measure the inductance value of the coin passing through accurately.

2. Description of the Related Art

Regular vending machines and game machines commonly have a coin acceptor, which uses a coin detector to detect the authenticity and value of inserted coins. A coin detector for this purpose according to the prior art design has an inductor element formed of a pot-like coil adapted to measure the inductance value of a coin. The inductor element may be made from iron, copper, nickel, aluminum, or lead. When electrically connected, the inductor element produces an oscillation frequency to induce the magnetic filed of any of a variety of coins. Subject to the coefficient of magnetism of the material of the coin detected, an eddy current is produced indicative of the intensity of the coefficient of magnetism of the coin. The inductance error of a pot-like coil is about 5~10%. A pot-like coil tends to break, and tends to be interfered with ambient temperature. Further, a pot-like coil requires much installation space.

SUMMARY OF THE INVENTION

The present invention has been accomplished to provide a coin detector for use in a coin acceptor, which eliminates the aforesaid drawbacks. It is therefore the main object of the present invention to provide a coin detector for use in a coin acceptor, which is highly reliable. It is another object of the present invention to provide a coin detector for use in a coin acceptor, which requires less installation space. It is still another object of the present invention to provide a coin detector for use in a coin acceptor, which is durable in use. According to the present invention, the coin detector is comprised of a frequency oscillation circuit, a frequency switching circuit, and a CPU (central processing unit). When installed in the track of a coin acceptor behind a face panel, the coin detector measures the inductance value of a coin been inserted into the track of the coin acceptor through a coin slot of the face panel and compares the measured inductance value to reference values stored in the CPU, so as to determine the authenticity and value of the coin. The oscillation circuit assembly comprises two printed circuit boards symmetrically disposed at two sides of the track of said coin acceptor, each printed circuit board having a spiral coil adapted to measure the inductance value of the coin passing through.

DETAILED DESCRIPTION OF THE PREFERRED EMBODIMENT

Figure 1:
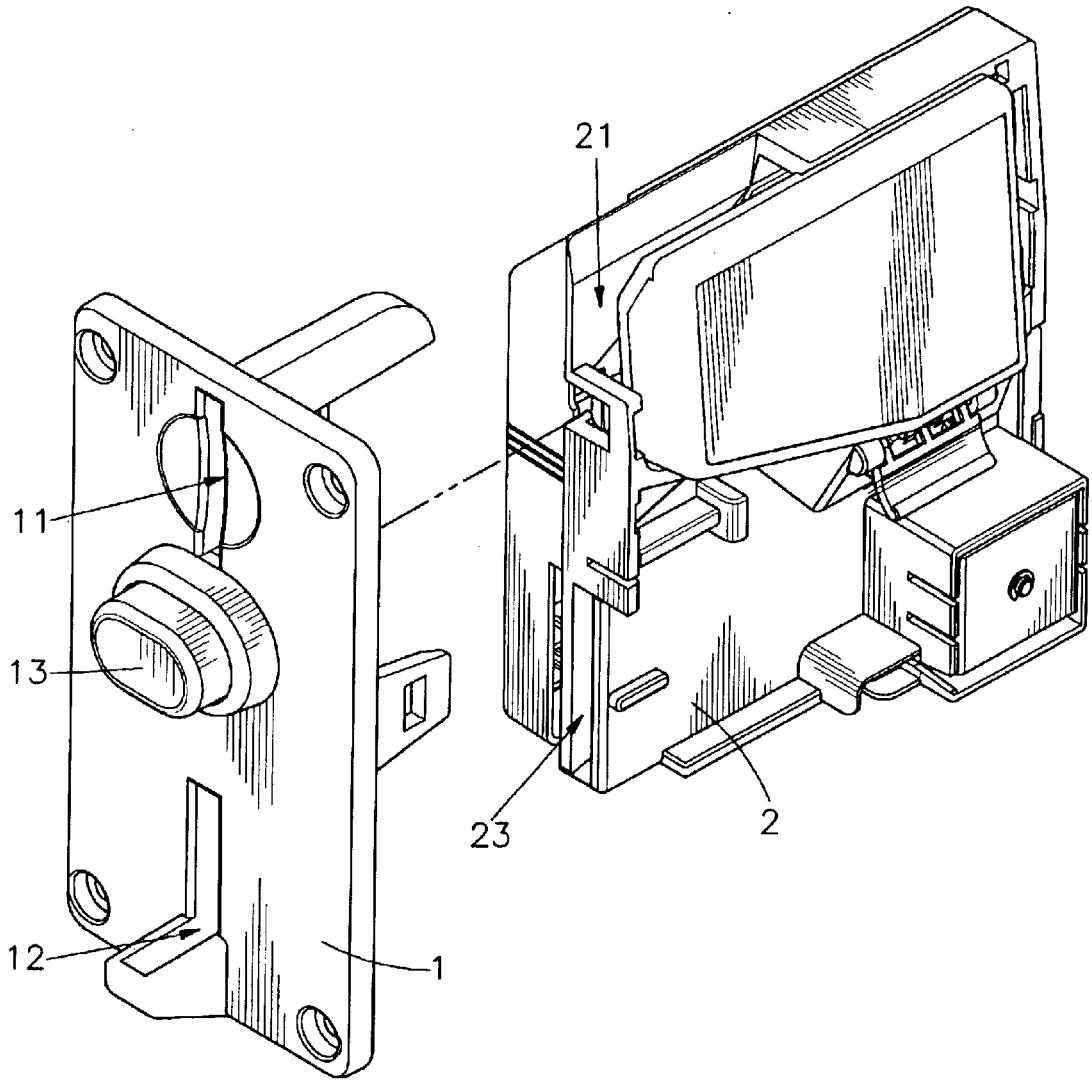
FIG. 1 is an exploded view of a face panel and a coin acceptor according to the present invention.
Figure 2:
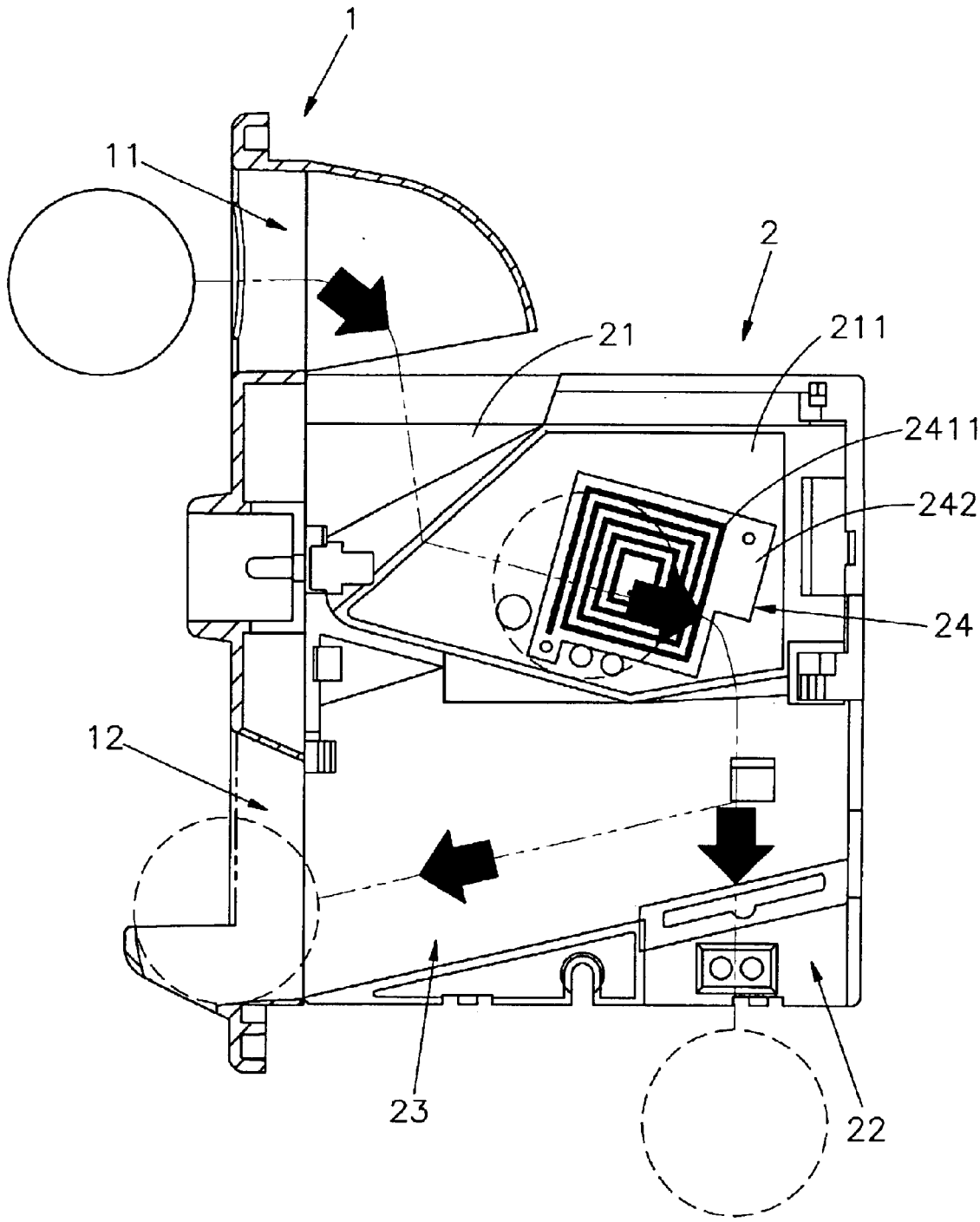
FIG. 2 is a sectional side view of the assembly of FIG. 1.

Referring to FIGS. 1, 2, 3, 5, and 5A, a coin acceptor 2 is provided at the back side of a face panel 1. The face panel 1 has a coin slot 11 near the top, and a return slot 12 near the bottom. The coin acceptor 2 has a coin inlet 21 connected to the coin slot 11 of the face panel 1, a coin outlet 22 connected to an external coin box (not shown), a coin return passageway 23 connected to the return slot 12 of the face panel 1, a track 211 extended from the coin inlet 21 to the coin outlet 22 and the coin return passageway 23, and a coin detector 24 installed in the track 211 and adapted to detect the authenticity and value of the coin inserted into the coin inlet 21 through the coin slot 11 of the face panel 1 and to selectively control the passage of the track 211 to the coin outlet 22 or the coin return passageway 23. The coin detector 24 comprises an oscillation circuit assembly 241 adapted to detect the inductance value of the coin passing through the track 211, a frequency switching circuit 243, the frequency switching circuit 243 having an analog multiplexer 2431 and a control port 2434, and a CPU 244 connected to the control port 2434 of the frequency switching circuit 243. When a coin entered the track 211, the oscillation circuit assembly 241 detects the inductive value of the coin, enabling the detected inductance value to be compared to reference values stored in the CPU 244, so as to determine the authenticity and value of the coin. When the authenticity of the coin proved, the coin detector 24 enables the coin to pass through the coin outlet 22 to the external coin box. If the coin is rejected (detected to be a counterfeit, the operator can then press the coin return button 13 at the face panel 1, enabling the coin to move to the coin return passageway 23 and then the coin return slot 12.

The aforesaid oscillation circuit assembly 241 can be comprised of two printed circuit boards 242 symmetrically provided at two opposite lateral sidewalls of the track 211. Each printed circuit board 242 has a spiral coil 2411 facing the track 211.

Figure 4:
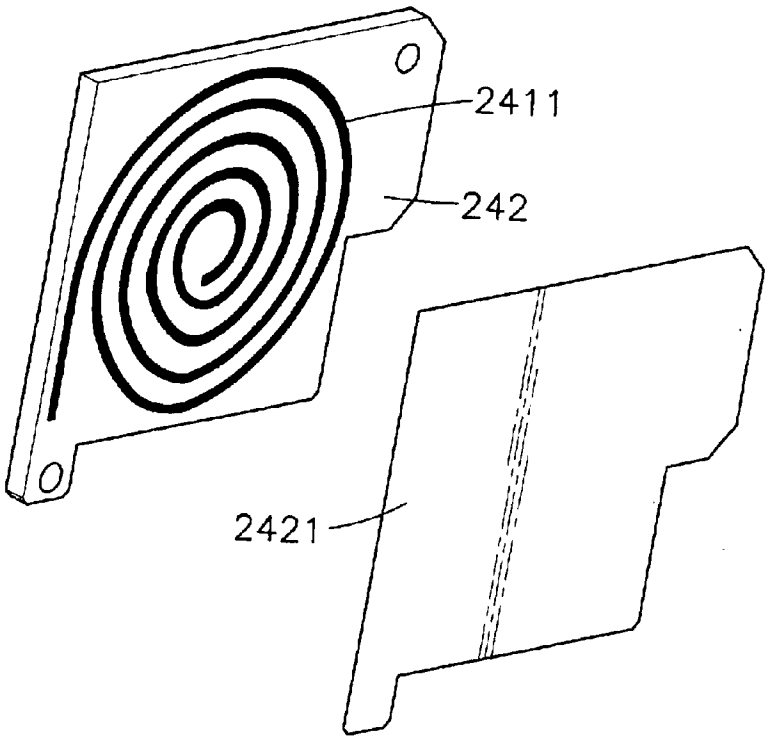
FIG. 4 is an exploded view of an alternate form of the printed circuit board according to the present invention.
Figure 3:
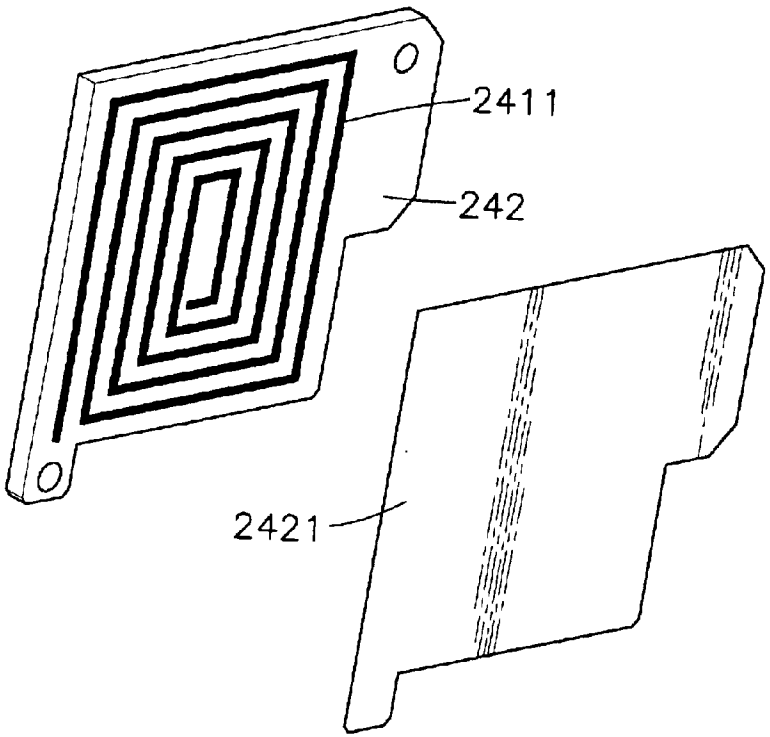
FIG. 3 is an exploded view of one printed circuit board for the oscillation circuit assembly according to the present invention.
Figure 5:
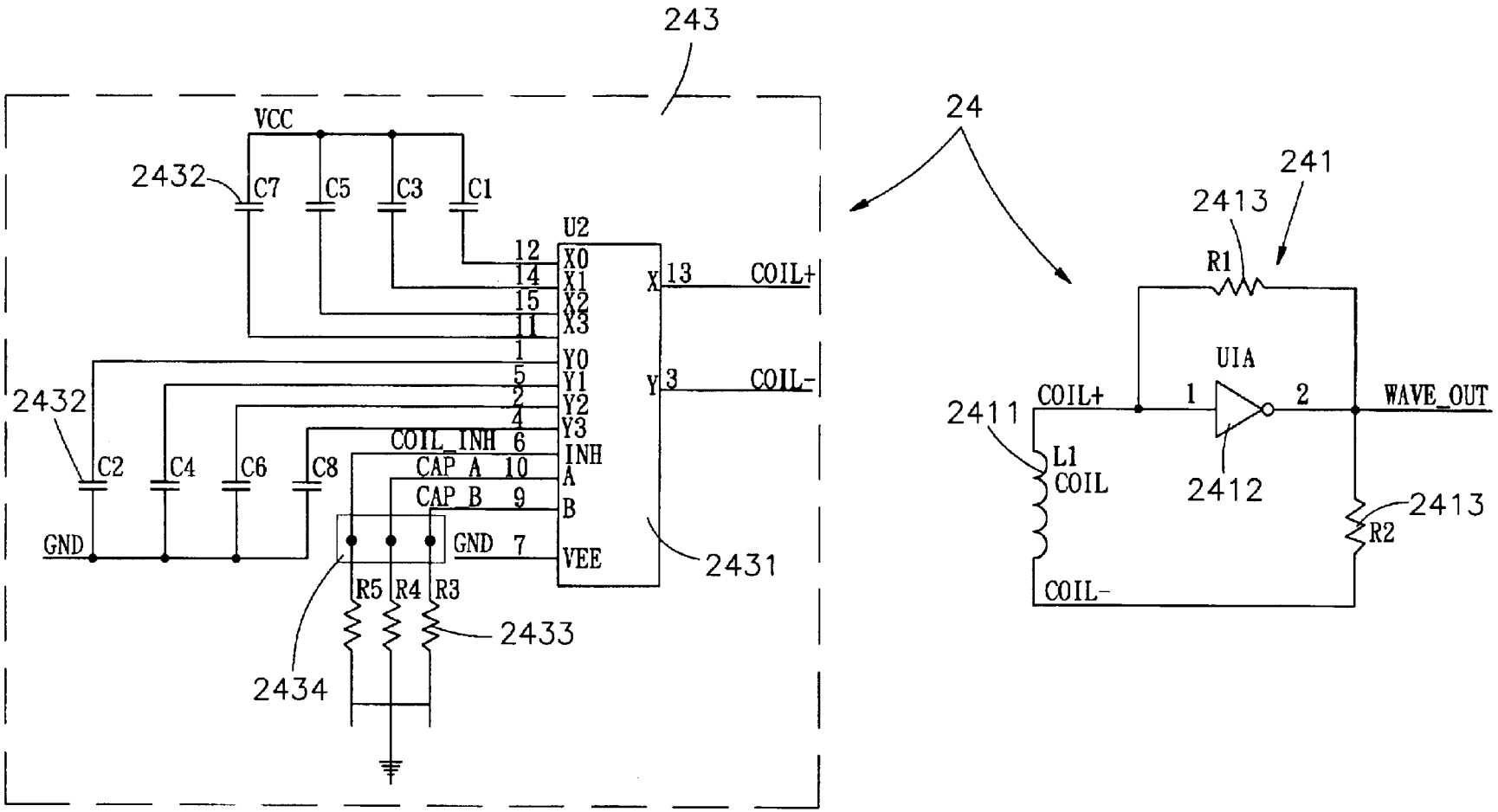
FIG. 5 is a circuit diagram of the coin detector according to the present invention (I).
Figure 5A:
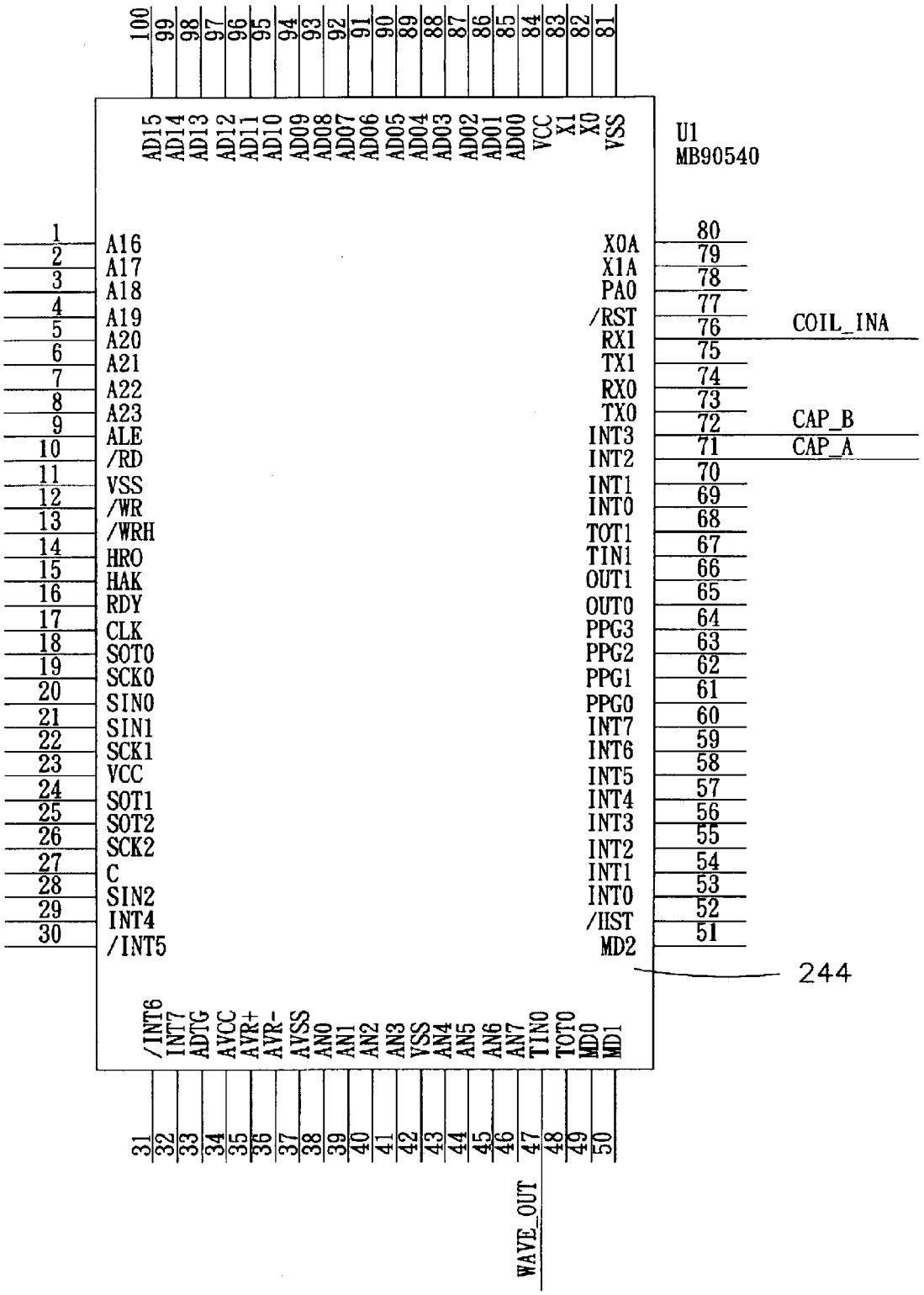
FIG. 5A is a circuit diagram of the coin detector according to the present invention (II).

With reference to FIGS. 3 and 4, the spiral coil 2411 on the circuit board 242 can be made having a rectangular profile as shown in FIG. 3, or a circular profile as shown in FIG. 4. Further, a thin layer of plastic coating 2421 is covered on the circuit board 242 over the spiral coil 2411. The thin layer of plastic coating 2421 can be polycarbonate.

Referring to FIGS. 5 and 5A again, the oscillation circuit assembly 241 comprises a spiral coil 2411, a shunt resistor 2412, and a logic gate 2413. The frequency switching circuit 243 comprises an analog multiplexer 2431, a plurality of capacitors 2432 and resistors 2433 respectively connected to the analog multiplexer 2431. The resistors 2433 form a control port 2434 connected to the CPU 244. The capacitors 2432 provide one of a set of oscillation frequencies for selection by the CPU 244 to use as a predetermined reference value.

Figure 6:
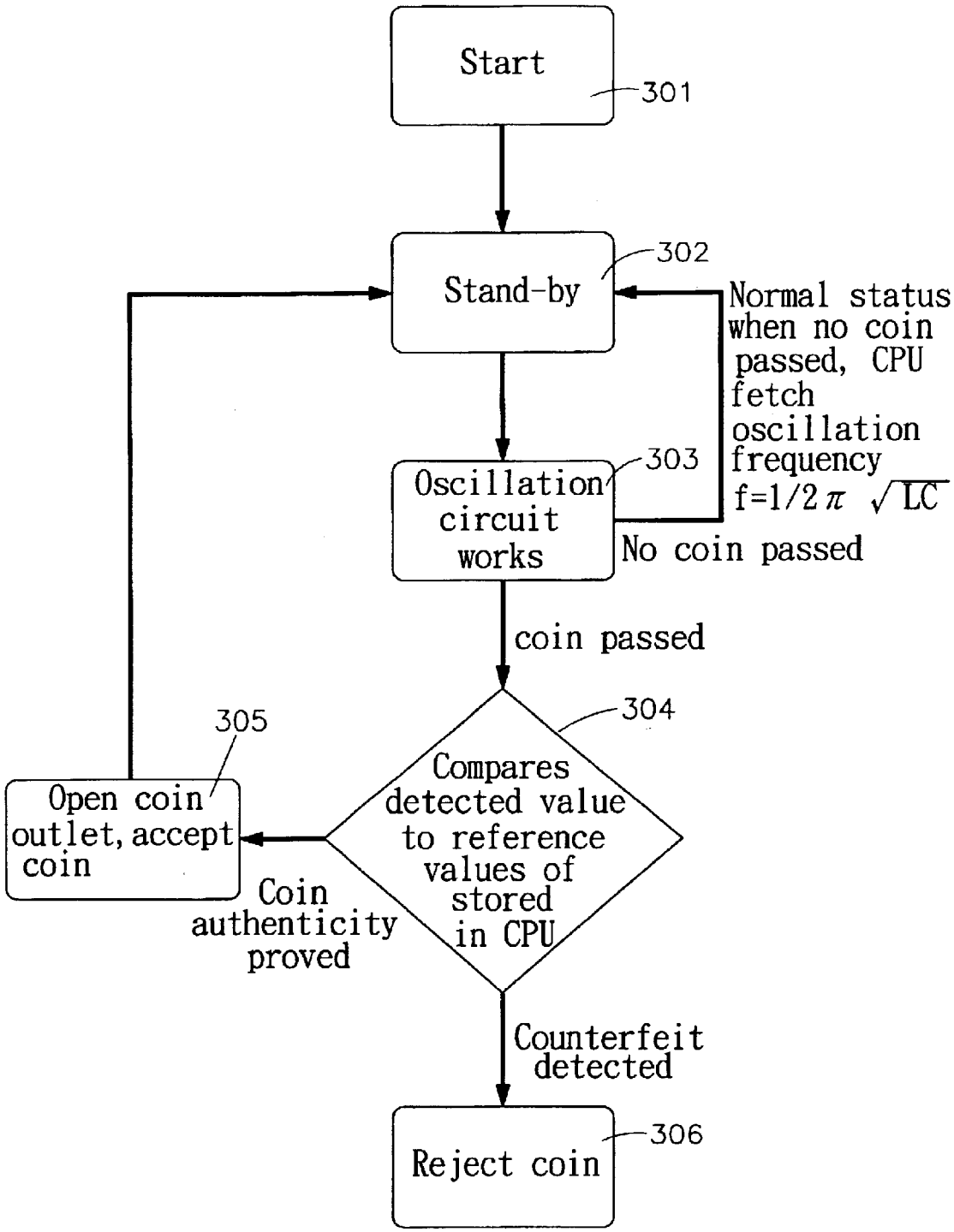
FIG. 6 is an operation flow chart of the present invention.

Referring to FIG. 6 and FIGS. 2, 3, 5 and 5A again, the operation of the present invention runs subject to the following steps:

301 Start;

302 Enter stand-by mode;

303 Analog multiplexer 2431 of frequency switching circuit 243 of oscillation circuit assembly 241 switches spiral coil 2411 and then transmits signal to CPU 244 for storage and then returns to step (302) when no coin passed; Spiral coil 2411 of oscillation circuit assembly 241 detects oscillation frequency upon passing of a coin and then oscillation circuit assembly 241 proceeds to step (304);

304 Compare oscillation frequency of coin detected with reference value stored in CPU 244 and then determine the authenticity of coin, and then proceed to step (305) if the authenticity of coil proved, or proceed to step (306) if coin is a counterfeit;

305 Open coin outlet 22 and accept coin, and then return to step (302);

306 Return counterfeit coin to coin return slot 22.

As indicated above, the invention has the following advantages:

1. High stability: Because the oscillation circuit assembly is comprised of two printed circuit boards symmetrically provided at two opposite lateral sidewalls of the track, the gap between spiral coils and the coin to be detected is minimized and, because the spiral coils are symmetrically provided at two sides of the track, the oscillation circuit assembly reliably detects the inductive frequency of the coin passing through.
2. Easy installation: The printed circuit boards of the oscillation circuit assembly can easily be installed in the two sides of the track inside the coin acceptor. Because the printed circuit boards of the oscillation circuit assembly are tough and the thickness of the printed circuit boards is thin, no frequent maintenance work is necessary.
3. High accuracy: The inductance error of the spiral coils of the oscillation circuit assembly is about within 0.1%, achieving high accuracy.

A prototype of coin detector for use in a coin acceptor has been constructed with the features of the annexed drawings of FIGS. 1~6. The coin detector for use in a coin acceptor functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A coin detector, installed in a truck of a coin acceptor at a back side of a face panel, comprising a frequency oscillation circuit assembly including a logic gate and a shunt resister, a frequency switching circuit, and a CPU (central processing unit), wherein said oscillation circuit assembly comprises two printed circuit boards symmetrically disposed at two side of the track of said coin acceptor, each circuit board has a spiral coil to detect an inductance value of a coin inserted through a coin slot of said face panel passing the track of said coin acceptor and wherein said CPU is adopted for measuring the inductance value comparing the measured inductance value with reference values stored in said CPU to determine the authenticity and value of the coin.

2. The coin detector as claimed in claim 1, wherein said spiral coil has a rectangular profile.

3. The coin detector as claimed in claim 1, wherein said spiral coil has a circular profile.

4. The coin detector as claimed in claim 1, wherein said frequency switching circuit comprises an analog multiplexer, and a plurality of capacitors and resistors respectively connected to said analog multiplexer.

5. The coin detector as claimed in claim 4, wherein said resistors form a control port connected to said CPU.

6. The coin detector as claimed in claim 1, wherein said printed circuit boards of said oscillation circuit each further comprise a thin layer of plastic coating covered over the respective spiral coil.

7. The coin detector as claimed in claim 6, wherein said thin layer of plastic coating is formed of polycarbonate.

8. A coin detector, installed in a track of a coin acceptor at a back side of a face panel, comprising:

a frequency oscillation circuit assembly, comprising two printed circuit boards symmetrically disposed at two sides of the track of said coin acceptor, each circuit board having a spiral coil facing each other for detecting an inductance value of a coin inserted into the track of said coin acceptor through a coin slot of said face panel;

a frequency switching circuit, comprising an analog multiplexer, and a plurality of capacitors and resistors respectively connected to said analog multiplexer; and a CPU (central processing unit), for measuring the inductance value of the coin, wherein the measured inductance value compared with reference values stored in said CPU to determine authenticity and value of the coin.

9. The coin detector as claimed in claim 8, wherein said spiral coil has a rectangular profile.

10. The coin detector as claimed in claim 8, wherein said spiral coil has a circular profile.

11. The coin detector as claimed in claim 8, wherein said resistors form a control port connected to said CPU.

12. The coin detector as claimed in claim 8, wherein each of said printed circuit boards of said oscillation circuit further comprise a thin layer of plastic coating covered over the respective spiral coil.

13. The coin detector as claimed in claim 12, wherein said thin layer of plastic coating is formed of polycarbonate.

14. A coin detector, installed in a track of a coin acceptor at a back side of a face panel, comprising:

a frequency oscillation circuit assembly, comprising two printed circuit boards symmetrically disposed at two sides of the track of said coin acceptor, each circuit board having a spiral coil facing each other for detecting an inductance value of a coin inserted into the track of said coin acceptor through a coin slot of said face panel;

a frequency switching circuit, comprising an analog multiplexer, and a plurality of capacitors arid resistors respectively connected to said analog multiplexer and said resistors form a control port connected to said CPU; and a CPU (central processing unit), for measuring the inductance value of the coin, wherein the measured inductance value compared with reference values stored in said CPU to determine authenticity and value of the coin.

15. The coin detector as claimed in claim 14, wherein said spiral coil has a rectangular profile.

16. The coin detector as claimed in claim 14, wherein said spiral coil has a circular profile.

17. The coin detector as claimed in claim 14, wherein each of said printed circuit boards of said oscillation circuit further comprise a thin layer of plastic coating covered over the respective spiral coil.

18. The coin detector as claimed in claim 17, wherein said thin layer of plastic coating is formed of polycarbonate.

* * * * *